United States Patent [19]

Jung

[11] Patent Number: 4,999,870

[45] Date of Patent: Mar. 19, 1991

[54] SHOE RIBBING MACHINE

[75] Inventor: Klaus Jung, Pirmasens, Fed. Rep. of Germany

[73] Assignee: Schön & Cie. GmbH, Pirmasens, Fed. Rep. of Germany

[21] Appl. No.: 476,547

[22] Filed: Feb. 7, 1990

[30] Foreign Application Priority Data

Mar. 3, 1989 [DE] Fed. Rep. of Germany ..... 3906733

[51] Int. Cl.[5] ..... A43D 21/14; A43D 75/00

[52] U.S. Cl. ..... 12/12.1; 12/13.1

[58] Field of Search ..... 12/8.6, 10.2, 10.6, 12/11.2, 12.1, 12.2, 12.3, 13.1, 12, 10.1, 8.1, 12.4, 10, 7

[56] References Cited

U.S. PATENT DOCUMENTS

| | | | |
|---|---|---|---|
| 2,660,740 | 12/1953 | Robinson | 12/12.1 |
| 4,602,398 | 7/1986 | Giebel | 12/10 |
| 4,630,325 | 12/1986 | Bender et al. | 12/12.1 |
| 4,853,997 | 8/1989 | Giebel | 12/13.1 |

FOREIGN PATENT DOCUMENTS

| | | | |
|---|---|---|---|
| 2160758 | 1/1986 | United Kingdom | 12/12 |

*Primary Examiner*—Steven N. Meyers

*Attorney, Agent, or Firm*—Wenderoth, Lind & Ponack

[57] ABSTRACT

A shoe ribbing machine of the present invention is particularly adapted to drive tacks into the insole of a shoe at a predetermined spacing through a ribbing disposed over the edge of the insole. The shoe ribbing machine includes a last over which a shoe upper including the insole can be fitted, a tack driving device confronting the last for driving tacks one after another into the insole of a shoe supported on the last, and a drive connected to one of the last and the tack driving device for moving the last and the tack driving device relative to one another. A measuring and pulse generating device is provided to detect the amount of relative movement between the last and the tack driving device. The measuring and pulse generating device issues pulses based on the detection of relative movement to control the rate at which the tack driving device drives tacks one after another as a function of the amount of relative movement between the last and the tack driving device. In this way, a constant spacing can be provided between the driven-in tacks irrespective of the speed at which the last and the tack driving device are moved relative to one another.

25 Claims, 3 Drawing Sheets

SHOE RIBBING MACHINE

BACKGROUND OF THE INVENTION

1. Field of the Invention

The present invention relates to a shoe ribbing machine for driving tacks into the insole of a shoe at a predetermined spacing through a rib disposed over the edge of the insole. The insole is part of a shoe upper that is fitted over a last of the shoe ribbing machine, the last being supported by a last carrier. More particularly, the present invention relates to a shoe ribbing machine including a tack driving device for driving tacks one after another into the insole of a shoe supported on a last, a tack conveying device for conveying tacks to the tack driving device, and a tack separating device for feeding the conveying device with tacks one at a time.

2. Description of the Related Art

In shoe ribbing machines of the above-mentioned type, a ribbing projecting above the last and to form part of the shoe upper is positioned along the edge of the insole by a screw, a peripheral band or inserters and is then fastened in place with tacks. Up to now, the driving-in of the tack by a tacking head of a tack driving device was controlled to move along the edge of the shoe upper in such a manner so as to drive tacks through the ribbing at predetermined time intervals. The beginning and ending of the tack driving-in process as well as the above predetermined time intervals from tack to tack can be set on the machine control of the shoe ribbing machine.

During the tack driving-in process, a supply of tacks accommodated in, for example, a magazine are separated into individual tacks, and the individual tacks are fed by a tack conveying device to the tack driving device. The tack conveying device has a tube or hose connected to the tack driving device and tacks are generally forced through the tube or hose by compressed air. The tack driving device is moved over the ribbing by, for example, a hydraulically or pneumatically driven cylinder. The speed at which the tack driving device is moved can be adjusted to be faster or slower by adjustment of the pressure or temperature of the operating medium of the cylinder. Since the operation of the tack separating device, the tack conveying device and the tack driving-in device, as well as the distance between successively driven tacks is based on time intervals set by the machine control of the shoe ribbing machine, the conventional shoe ribbing machine presents a significant drawback in that such time intervals are not constantly adjusted to correspond to the speed at which the tack driving device is moved. Accordingly, the distances between successively driven tacks are shorter along the ribbing when the tack driving device is moved slower than when it is moved faster.

SUMMARY OF THE INVENTION

An object of the present invention is to provide a shoe ribbing machine of the above-mentioned type in which the tack spacing between successive ones of a plurality of tacks driven through ribbing can be maintained constant independently of the speed of relative movement between the tack driving device and a last on which the insole of a shoe upper is supported.

To achieve the above object, the present invention comprises a measuring and pulse generating means operatively connected to the tack driving device for detecting the amount of relative movement between the last and the tack driving device, and for issuing pulses based on the detection to control the rate at which the tack driving device drives tacks one after another as a function of the amount of relative movement between the last and the tack driving device. Thus, according to the shoe ribbing machine of the present invention, it is ensured that the spacing between a plurality of successively driven tacks always remains a constant independent of the speed at which the last and the tack driving means are moved relative to one another. Accordingly, it is ensured that first, many unnecessary tacks will not be driven into the insole and secondly, that a ribbing is nevertheless fastened adequately and reliably around the insole.

Other objects, features, advantages and applications of the present invention will become apparent from the following detailed description of preferred embodiments of the present invention made with reference to the accompanying drawings.

DETAILED DESCRIPTION OF THE PREFERRED EMBODIMENTS

Figure 1A:
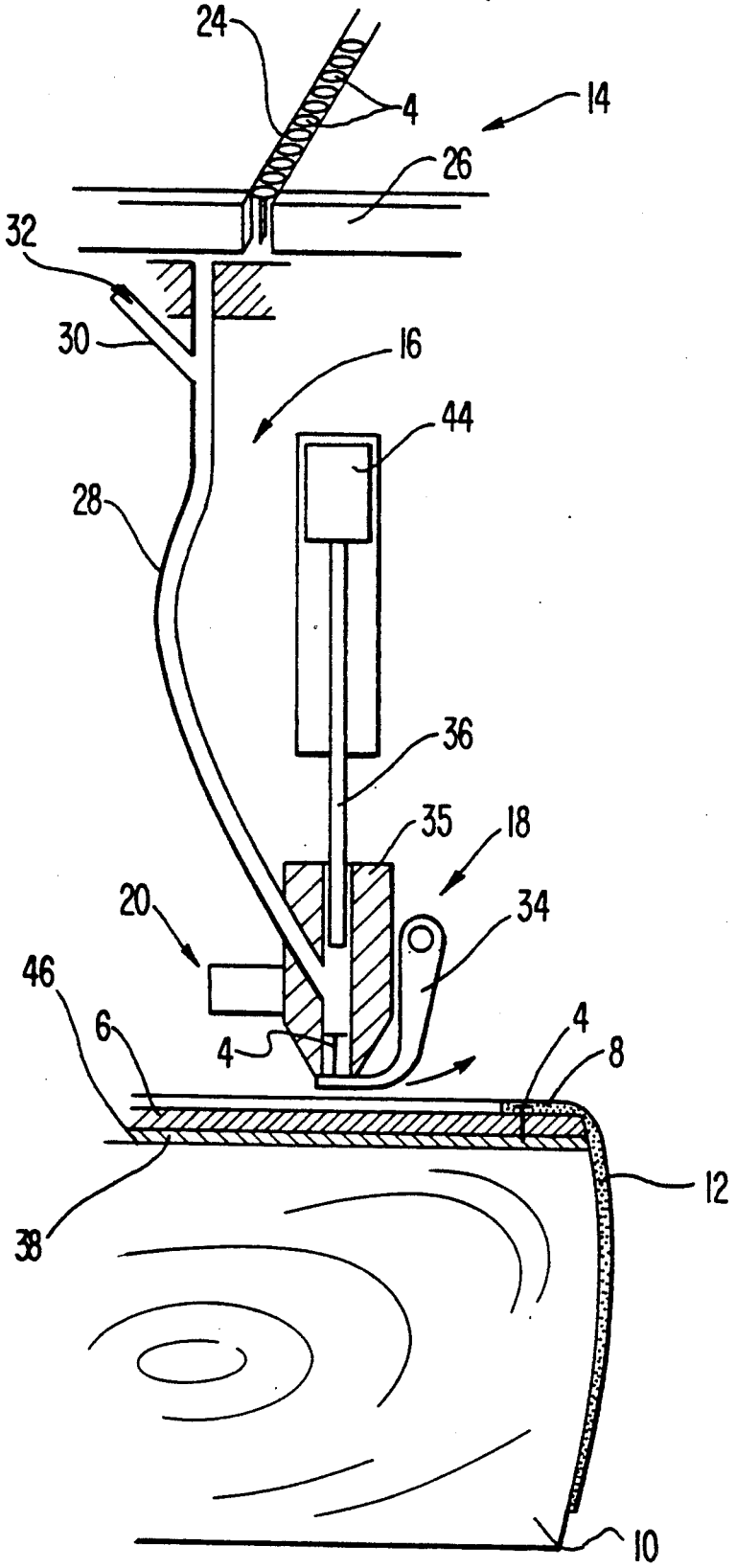
FIG. 1A is a schematic diagram of a shoe ribbing machine according to the present invention.
Figure 1B:
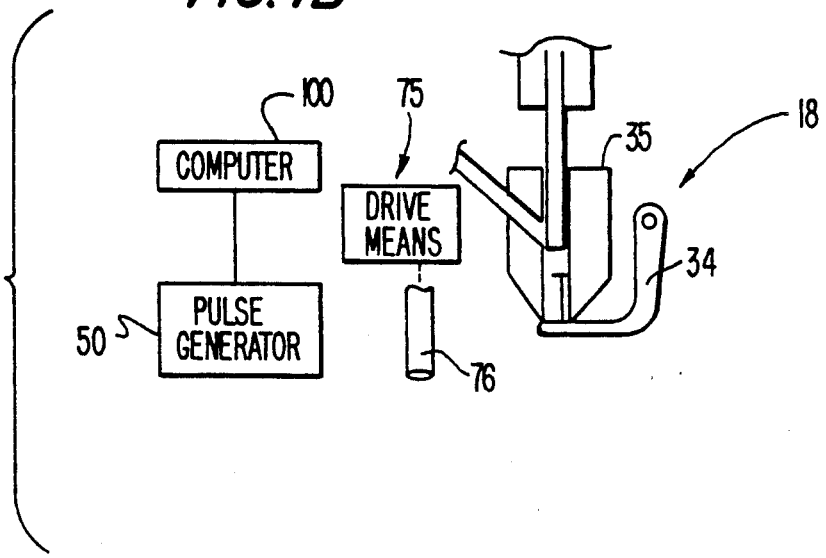
FIGS. 1B and 1C are respective explanatory diagrams schematically illustrating the operative relationship between a measuring and pulse generating means and a drive means for driving one of a last and a tack driving device in the shoe ribbing machine of FIG. 1A.
Figure 1C:
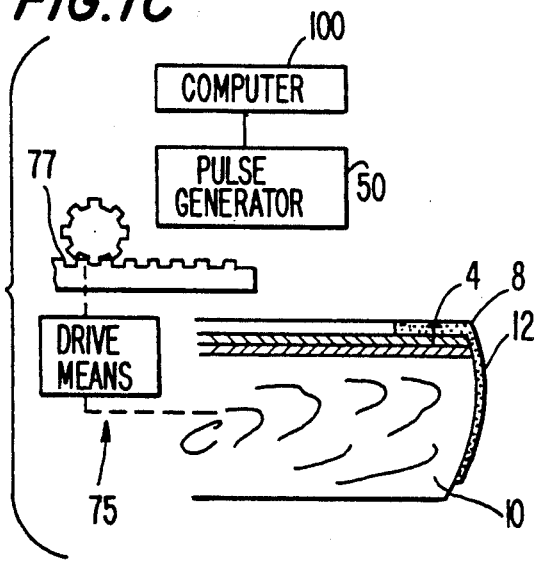

Referring to the schematic diagram of FIGS. 1A–1D, the shoe ribbing machine according to the present invention comprises tack separating means 14, a tack conveying means 16, and a tack driving means 18. The tack separating means 14 is disposed at the outlet of a magazine 24 which contains a supply of tacks 4. The tacks 4 are fed toward the tack separating means 14, for example, under the force of a spring (not shown) or under the force of gravity. The tack separating means 14 comprises a separator 26 which reciprocates at the outlet of the magazine 24 to separate the tacks 4 from the supply thereof in the magazine and feed them to the tack conveying means 16.

The tack conveying means 16 comprises a tube or hose 28 into which individual ones of the tacks 4 fall after having been separated and fed thereto by the separator 26. A tack 4 is thus fed to the tack driving means 18 through the tube or hose 28. The tack separating means 14 is disposed above the tack driving means 18 whereby gravity is used to convey the tacks one at a time through the tube or hose 28 to the tack driving means 18. To facilitate such gravitational conveyance of the tacks 4 which always tend to fall point first into the tube or hose 28, the tack conveying means 16 also comprises an additional tube or an additional hose 30 which is connected and open to the tube or hose 28. A stream of compressed air 32 is fed through the additional tube or additional hose 30 once the tack falling under gravity has passed the location at which the additional tube or additional hose 30 is open to the tube or hose 28.

The tack driving means 18 comprises a cylinder 35 to which the tube or hose 28 is connected whereby tacks are conveyed by the tack conveying means 16 into the cylinder 35, a tack catcher 34 extending to a location below the cylinder 35 for preventing tacks from falling out of the cylinder 35, and a piston device comprising a piston rod 36 guided by the cylinder 35 and a piston 44 driven within a cylinder. Thus, tacks are driven in by the controlled movement of the tack catcher 34 in the direction of the arrow shown in FIG. 1A and movement of the piston rod 36 downward under the action of operating medium acting on the piston 44 disposed in the cylinder.

A measuring and pulse generating means 20 of the present invention, described in more detail below, is located at the tack driving means 18.

Also shown in FIG. 1A is a last 10 supported on a last carrier (not shown). The last 10 is disposed below the tack driving means 18 such that the tack driving means confronts the last 10 for driving tacks one after another into the insole 6 of a shoe upper 12, fitted over the bottom 46 of the last 10, through ribbing 8 which extends around the insole 6. To prevent the driven-in tacks from projecting into the finished shoe, the last bottom 46 is provided with a steel lining 38 which causes the driven-in tacks 4 to be bent over at the ends thereof which are projected through the insole 6 when driven in by the tack driving means 18.

Figure 2:
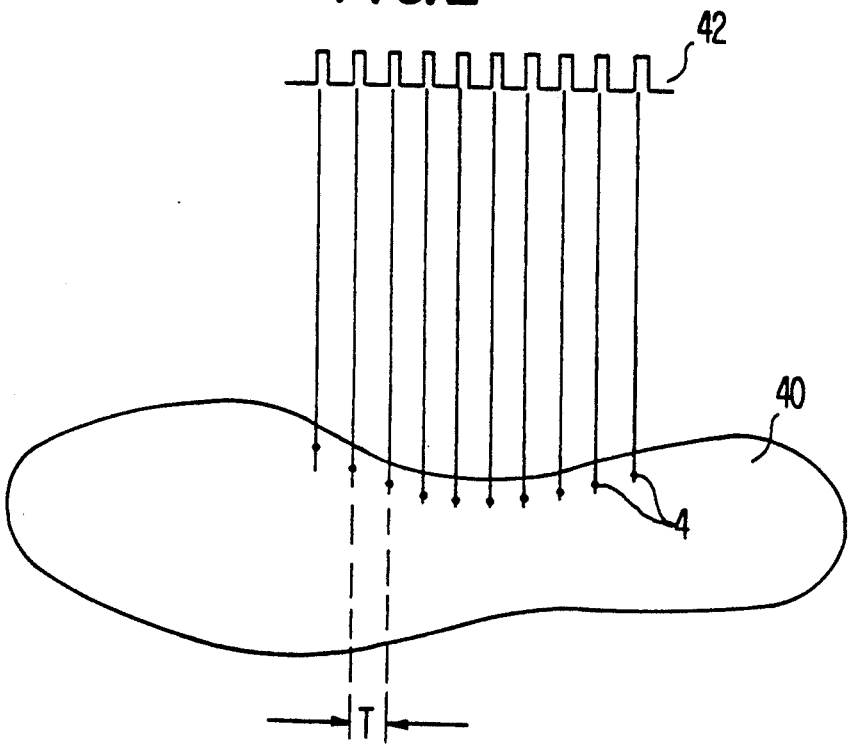
FIG. 2 is an explanatory diagram illustrating the outline of a last and a diagram line of a plurality of cycles over which tacks are to be driven with a constant spacing therebetween.
Figure 3:
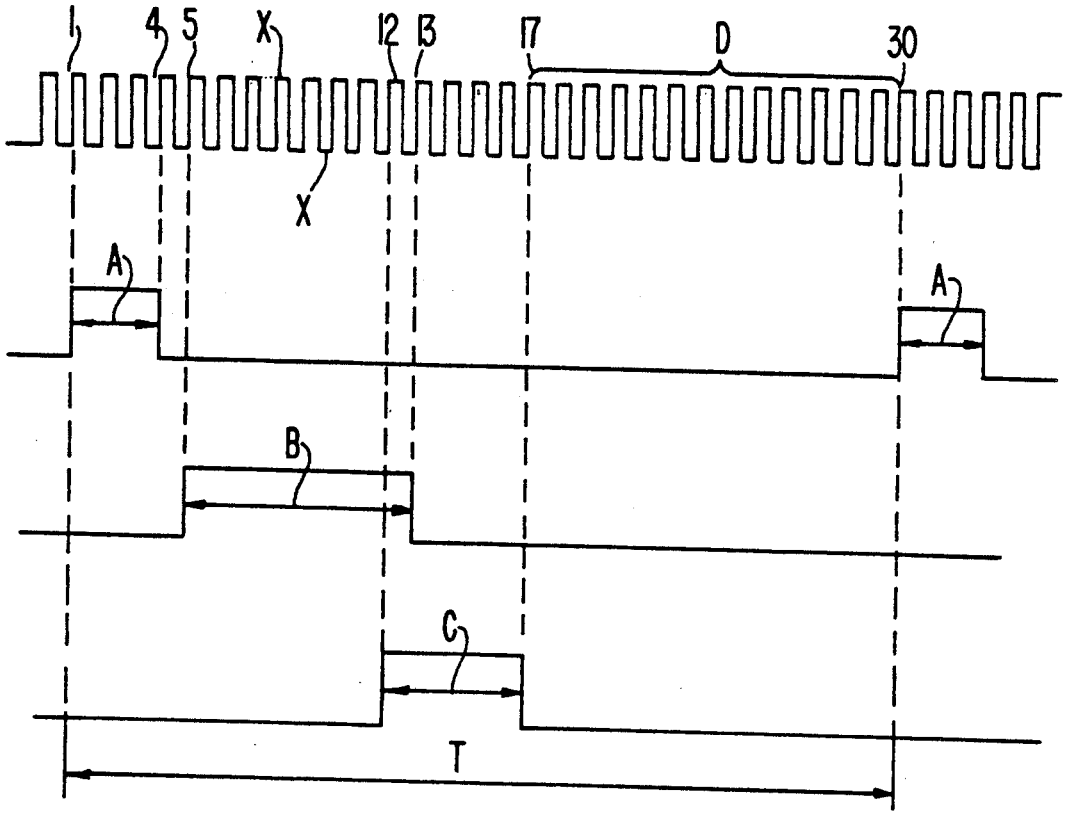
FIG. 3 is an operational diagram showing the control of a tack driving means, a tack conveying means, and a tack separating means by the measuring and pulse generating means of the present invention during one of the cycles in which the driving-in of a tack is completed.

Referring now to FIG. 2, FIG. 2 shows an outline 40 of the bottom 46 of the last 10. Shown along the edge of the outline 40 of the bottom 46 of the last 10 are drive-in points of the tacks 4 having a constant spacing T therebetween. Diagram line 42 represents a plurality of cycles, one of which is shown in FIG. 3, in each of which cycles the driving-in of a tack 4 is completed. The present invention is able to drive in tacks successively with a constant spacing T therebetween independent of the speed at which the tack driving means 18 and the last 10 are move relative to one another as will be described below.

Referring now to FIGS. 1A–1D and 3, the measuring and pulse generating means 20 detects the amount of relative movement between the last 10 and the tack driving means 18. The measuring and pulse generating means 20 preferably comprises a digital, rotational or linear pulse generator 50 and a computer 100 coupled to the pulse generator 50.

A drive means is operatively connected to one of the last 10, via the last carrier (not shown), and the tack driving means 18 for moving one of the last 10 and the tack driving means 18 relative to the other in a pattern corresponding to a preselected pattern, a portion of which is shown in FIG. 2, in which tacks are to be driven through the ribbing 8 of a shoe upper supported on the last 10.

For carrying out the detection of the amount of relative movement between the last 10 and the tack driving means 18, the measuring and pulse generating means 20 of the present invention can detect the amount of movement of a moving part of the drive means operatively connected to one of the last 10 and the tack driving means 18. For example, as shown in the schematic diagrams of FIGS. 1B and 1C, the measuring and pulse generating means 20 is in operative association with a moving part of the drive means 75, which moving part can comprise a spindle 76 or a rack and pinion device 77 operatively connected in a driving relation to the tack driving means 18 or the last carrier supporting the last 10, so as to detect the amount of relative movement between the last 10 and the tack driving means 18 based on the movement of the spindle 76 or rack and pinion device 77. In the embodiment shown in FIG. 1A, the measuring and pulse generating means 20 is fixed to the tack driving means 18 which is moved by drive means 75 relative to the last 10 whereby the measuring and pulse generating means 20 can detect relative movement between the tack driving means 18 and the last 10 based on the movement of a moving part of the drive means 75.

In the manner described above, pulses output by the digital, rotational or linear pulse generator 50 corresponding to the amount of movement of the moving part of the drive means 75 operatively connected to one of the tack driving means 18 and the last carrier supporting the last 10 can be easily converted by the computer 100 to the amount of relative movement between the tack driving means 18 and the last 10.

Figure 1D:
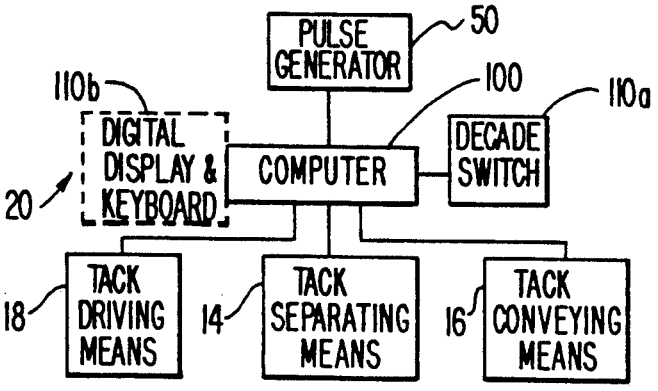
FIG. 1D is a block diagram of the machine control for the shoe ribbing machine of FIG. 1A.

As seen in the block diagram of FIG. 1D, the measuring and pulse generating means 20 is operatively connected to the tack driving means 18. Pulses generated by the measuring and pulse generating means 20 are issued to the tack driving means 18 to control the operation of the tack driving means 18 whereby the rate at which the tack driving means 18 drives tacks one after another can be controlled as a function of the amount of relative movement between the last 10 and the tack driving means 18. Thus, with a fixed output of the other elements of the shoe ribbing machine such as the tack separating means 14 and tack conveying means 16, i.e. with a constant and continuous supply of tacks 4, it suffices to control only the tack driving means 18 with the measuring and pulse generating means 20 to facilitate the driving-in of tacks at a constant spacing T therebetween. However, according to another version of the present invention, the tack separating means 26 and/or the tack conveying means are operatively connected to the measuring and pulse generating means 20 so as to also be controllable by pulses output by the measuring and pulse generating means 20. To ensure a continuously constant spacing between the tacks under the simple control of the different means of the present invention such as the control of the tack driving means 18, the measuring and pulse generating means 20 of the present invention issues pulses with a constant interval therebetween satisfying the equation $$T=kX$$

wherein T is the constant spacing between adjacent ones of a plurality of successively driven tacks, X is the constant interval between pulses issued by the measuring and pulse generating means 20, and k is a natural number of pulses issued by the measuring and pulse generating means over a cycle in which the driving-in of a tack is completed. In other words, each pulse output by the measuring and pulse generating means 20 preferably corresponds to a constant partial distance of the tack spacing T.

FIG. 3 is an operational diagram illustrating the operative relationship between the measuring and pulse generating means 20 of the present invention and the tack driving means 18, tack separating means 26 and tack conveying means 16. Each cycle of the tacking operation in which the driving-in of a tack is completed, during relative motion between the tack driving means 18 and the last 10, comprises a separating process during which the tack separating means 26 is controlled by pulses issued by the measuring and pulse generating means 20, a conveying process during which the tack conveying means 16 is controlled by pulses issued by the measuring and pulse generating means 20, a driving-in process during which the tack driving means 18 is controlled by pulses issued by the measuring and pulse generating means 20, and an idling process during which a selected number of pulses must be issued by the measuring and pulse generating means 20 before the cycle is repeated. In FIG. 3, the separating process occurs over a distance A corresponding to a predetermined fraction of the constant spacing T. Likewise, the conveying process is carried out over a conveying distance B which also corresponds to a fraction of the constant tack spacing T, and the driving-in process is carried over a driving-in distance C which corresponds to a fraction of the constant tack spacing T. The idle process occurs over a distance D making up the remainder of the constant tack spacing T. It is to be noted that the measuring and pulse generating means 20 of the present invention comprises one of a digital, rotational or linear pulse generator so as to be able to generate a suitably high number of pulses per unit time. A high pulse number per unit time permits the entire cycle, including the individual separating, conveying, driving-in and idle processes to be readily adjustable as will be described in further detail below. The pulses issued by the measuring and pulse generating means 20 have essentially constant intervals X therebetween which correspond to an essentially constant amount of relative movement between the tack driving means 18 and the last 10 during each cycle of the tack driving-in process in which the driving-in of a tack is completed.

As seen in FIG. 3, a predetermined number of pulses are issued by the measuring and pulse generating means 20. In the cycle shown in FIG. 3, 30 pulses are issued. Pulse 1 is issued to the tack separating means 14 whereby the tack separator 26 begins the separation of an individual tack 4 from the supply of tacks 4 accommodated in the magazine 24. An individual tack 4 is thus moved by the tack separating means 14 by the issuance of pulses 1–4 to the tack separating means 14. At the issuance of pulse 4, an individual tack 4 is fed into the tube or hose 28 of the tack conveying means 16 and the separator 26 is returned to its home position in alignment with the outlet of the magazine 24. Following the issuance of pulse 4, the tack separating means 14 receives no further pulses during the remainder of the cycle. During the tack separating process, the tack driving means 18 has travelled over the separating distance A relative to the last 10 and thus relative to the ribbing 8. The issuance of pulse 5 is received by the tack conveying means 16 to cause the stream of compressed air 32 to be fed through the tube or hose 28 via the additional tube or additional hose 30. Between pulses 5 and 13, an individual tack 4 is fed via the tube or hose 28 to the cylinder 35 of the tack driving means 18. The individual tack 4 arrives in the cylinder 35 no later than the issuance of pulse 12. At this time, the supply of compressed air can be interrupted. The control of the tack conveying means 16 terminates with the issuance of pulse 13. Thus, during the conveying process, the tack conveying means 16 receives pulses, i.e. pulses 5–13, only during the conveying distance B. Upon the issuance of pulse 12, the tack driving means 18 is controlled such that the tack catcher 34 thereof is swung in the direction of the arrow shown in FIG. 1A. At the same time, the piston rod 36 is moved downwards so as to drive the tack 4 through the ribbing 8 and into the insole 6 of a shoe upper supported on the last 10. Upon the completion of the driving-in of the tack 4, the driving rod 36 is moved back to its initial position. The control of the tack driving means 18 by the pulses 12–17 issued by the measuring and pulse generating means 20 occurs over the driving-in distance C. The tack driving means 18 and the last 10 travel relative to one another over the blank distance D during the issuance of pulses 18–30.

The blank distance D serves the purpose of facilitating a change in the tack spacing T whereas the working distance during which pulses 1–17 are issued remains preferably unaltered following an optimal adjustment of the machine parts. An adjusting means (FIG. 1D) such as a decade switch 110*a* or a digital display in millimeters comprising a keyboard 110*b* allows an operator to select the desired tack spacing T. The computer 100 calculates the number of pulses that must be issued by the measuring and pulse generating means 20 when the tack spacing T is selected.

More specifically, it is preferable that once the number of pulses to be issued by the measuring and pulse generating means 20 to control the tack separating means 14, the tack conveying means 16 and the tack driving means 18 have been optimally set, such numbers should not be changed when adjusting the tack spacing T. To increase or shorten the tack spacing T it is preferred for only a new number of pulses to be issued after the issuance of pulses to the tack driving means 18 so as to change the blank distance D. In other words, the computer 100 allows the constant spacing T in a previous cycle to be adjusted to a new constant spacing in a subsequent cycle by only changing the natural number of pulses issued by the measuring and pulse generating means 20 over the previous cycle while maintaining the same number of pulses which the measuring and pulse generating means 20 issued in the previous cycle to optimally control any or all of the tack driving means, the tack conveying means and the tack separating means.

It should be noted that optimal adjustment of any or all of the separating, conveying, driving-in processes and/or the overall tacking process can be facilitated by adjusting the number of pulses during the cycle which are issued to the tack separating means 14, tack conveying means 16, tack driving means 18 and/or by adjusting the total number of pulses.

The present invention has been described above with respect to a preferred embodiment thereof. However, various changes and modifications will become apparent to those of ordinary skill in the art and any of such changes or modifications encompassed by the appended claims are seen to fall within the true spirit and scope of the invention.

What is claimed is:

1. A shoe ribbing machine for driving tacks into the insole of a shoe at a predetermined spacing through a ribbing disposed over the edge of the insole, said shoe ribbing machine comprising:

a last;

tack driving means confronting said last for driving tacks one after another into the insole of a shoe supported on said last;

drive means operatively connected to one of said last and said tack driving means for moving said one of said last and said tack driving means relative to the other of said last and said tack driving means in a pattern corresponding to a preselected pattern in which tacks are to be driven into the insole of a shoe supported on said last; and measuring and pulse generating means operatively connected to said tack driving means for detecting the amount of relative movement between said last and said tack driving means, and for issuing pulses based on the detection to control the rate at which said tack driving means drives tacks one after another as a function of the amount of relative movement between said last and said tack driving means.

2. A shoe ribbing machine as claimed in claim 1, and further comprising tack conveying means connected to said tack driving means for conveying tacks to said tack driving means.

3. A shoe ribbing machine as claimed in claim 2, and further comprising tack separating means in operative association with said tack conveying means for feeding said conveying means with tacks one at a time.

4. A shoe ribbing machine as claimed in claim 2, wherein said measuring and pulse generating means is operatively connected to said tack conveying means for issuing pulses to control the rate at which said tack conveying means conveys tacks to said tack driving means.

5. A shoe ribbing machine as claimed in claim 4, wherein said measuring and pulse generating means controls said tack driving means to drive tacks into the insole of a shoe with a constant spacing therebetween, and said measuring and pulse generating means issues said pulses with a constant interval therebetween satisfying $$T=kX$$

wherein T is said constant spacing, X is said constant interval, and k is a natural number of pulses issued by said measuring and pulse generating means over a cycle in which the driving-in of a tack is completed.

6. A shoe ribbing machine as claimed in claim 5, wherein said measuring and pulse generating means comprises a computer which is capable of allowing the number of pulses, which said measuring and pulse generating means issues each said cycle to control said tack driving means, to be adjusted.

7. A shoe ribbing machine as claimed in claim 5, wherein said measuring and pulse generating means comprises a computer which is capable of allowing said constant spacing in a previous said cycle to be adjusted to a new constant spacing in a subsequent said cycle by only changing said natural number of pulses issued by said measuring and pulse generating means over the previous said cycle while maintaining the same number of pulses which said measuring and pulse generating means issued in the previous said cycle to control said tack driving means.

8. A shoe ribbing machine as claimed in claim 3, wherein said measuring and pulse generating means is operatively connected to said tack conveying means for issuing pulses to control the rate at which said tack conveying means conveys tacks to said tack driving means.

9. A shoe ribbing machine as claimed in claim 8, wherein said measuring and pulse generating means controls said tack driving means to drive tacks into the insole of a shoe with a constant spacing therebetween, and said measuring and pulse generating means issues said pulses with a constant interval therebetween satisfying $$T=kX$$

wherein T is said constant spacing, X is said constant interval, and k is a natural number of pulses issued by said measuring and pulse generating means over a cycle in which the driving-in of a tack is completed.

10. A shoe ribbing machine as claimed in claim 9, wherein said measuring and pulse generating means comprises a computer which is capable of allowing the number of pulses, which said measuring and pulse generating means issues each said cycle to control said tack driving means, to be adjusted.

11. A shoe ribbing machine as claimed in claim 9, wherein said measuring and pulse generating means comprises a computer which is capable of allowing said constant spacing in a previous said cycle to be adjusted to a new constant spacing in a subsequent said cycle by only changing said natural number of pulses issued by said measuring and pulse generating means over the previous said cycle while maintaining the same number of pulses which said measuring and pulse generating means issued in the previous said cycle to control said tack driving means.

12. A shoe ribbing machine as claimed in claim 8, wherein said measuring and pulse generating means is operatively connected to said tack separating means for issuing pulses to control the rate at which said tack separating means feeds tacks to said conveying means one at a time.

13. A shoe ribbing machine as claimed in claim 12, wherein said measuring and pulse generating means controls said tack driving means to drive tacks into the insole of a shoe with a constant spacing therebetween, sand said measuring and pulse generating means issues said pulses with a constant interval therebetween satisfying $$T=kX$$

wherein T is said constant spacing, X is said constant interval, and k is a natural number of pulses issued by said measuring and pulse generating means over a cycle in which the driving-in of a tack is completed.

14. A shoe ribbing machine as claimed in claim 13, wherein said measuring and pulse generating means comprises a computer which is capable of allowing the number of pulses, which said measuring and pulse generating means issues each said cycle to control said driving means, said tack conveying means, and said tack separating means, to be adjustable.

15. A shoe ribbing machine as claimed in claim 13, wherein said measuring and pulse generating means comprises a computer which is capable of allowing said constant spacing in a previous said cycle to be adjusted to a new constant spacing in a subsequent said cycle by only changing said natural number of pulses issued by said measuring and pulse generating means over the previous said cycle while maintaining the same number of pulses which said measuring and pulse generating means issued in the previous said cycle to control said tack driving means, said tack conveying means and said tack separating means.

16. A shoe ribbing machine as claimed in claim 1, wherein said measuring and pulse generating means controls said tack driving means to drive tacks into the insole of a shoe with a constant spacing therebetween, and said measuring and pulse generating means issues said pulses with a constant interval therebetween satisfying $$T=kX$$

wherein T is said constant spacing, X is said constant interval, and k is a natural number of pulses issued by said measuring and pulse generating means over a cycle in which the driving-in of a tack is completed.

17. A shoe ribbing machine as claimed in claim 16, wherein said measuring and pulse generating means comprises a computer including a decade switch for allowing the number of pulses issued by said measuring and pulse generating means in said cycle to be changed to adjust said constant spacing.

18. A shoe ribbing machine as claimed in claim 16, wherein said measuring and pulse generating means comprises a computer including a digital display having a keyboard for allowing the number of pulses issued by said measuring and pulse generating means in said cycle to be changed to adjust said constant spacing.

19. A shoe ribbing machine as claimed in claim 16, wherein said measuring and pulse generating means comprises a computer which is capable of allowing the number of pulses, which said measuring and pulse generating means issues each said cycle to control said tack driving means, to be adjusted.

20. A shoe ribbing machine as claimed in claim 16, wherein said measuring and pulse generating means comprises a computer which is capable of allowing said constant spacing in a previous said cycle to be adjusted to a new constant spacing in a subsequent said cycle by only changing said natural number of pulses issued by said measuring and pulse generating means over the previous said cycle while maintaining the same number of pulses which said measuring and pulse generating means issued in the previous said cycle to control said tack driving means.

21. A shoe ribbing machine as claimed in claim 1, wherein said measuring and pulse generating means comprises one of a digital, rotational and linear pulse generator, and a computer operatively connected to said pulse generator.

22. A shoe ribbing machine as claimed in claim 1, wherein said drive means comprises a moving part, and said measuring and pulse generating means is in operative association with said moving part of said drive means for detecting the amount of relative movement between said last and said tack driving means based on the movement of said moving part.

23. A shoe ribbing machine as claimed in claim 22, wherein said moving part is a rack and pinion device.

24. A shoe ribbing machine as claimed in claim 22, wherein said moving part is a spindle.

25. A shoe ribbing machine as claimed in claim 1, wherein said measuring and pulse generating means is fixedly connected to said one of said last and said tack driving means.

* * * * *